US007055576B2

(12) United States Patent
Fernstrum

(10) Patent No.: US 7,055,576 B2
(45) Date of Patent: Jun. 6, 2006

(54) METHOD AND APPARATUS FOR ENHANCING THE HEAT TRANSFER EFFICIENCY OF A KEEL COOLER

(75) Inventor: Todd S. Fernstrum, Menominee, MI (US)

(73) Assignee: R.W. Fernstrum & Co., Menominee, MI (US)

( * ) Notice: Subject to any disclaimer, the term of this patent is extended or adjusted under 35 U.S.C. 154(b) by 2 days.

(21) Appl. No.: 10/304,847

(22) Filed: Nov. 27, 2002

(65) Prior Publication Data

US 2003/0098141 A1 May 29, 2003

Related U.S. Application Data

(60) Provisional application No. 60/333,137, filed on Nov. 27, 2001.

(51) Int. Cl.

| | |
|---|---|
| ***B60H 3/00*** | (2006.01) |
| ***F28D 1/00*** | (2006.01) |
| ***F28D 1/02*** | (2006.01) |
| ***F28D 1/04*** | (2006.01) |

(52) U.S. Cl. ..... 165/44; 165/41; 165/51; 165/173; 165/174; 165/178; 440/88 HE

(58) Field of Classification Search ..... 165/41, 165/44, 178, 173, 174, 51; 440/88 HE
See application file for complete search history.

(56) References Cited

U.S. PATENT DOCUMENTS

| | | | | |
|---|---|---|---|---|
| 968,385 | A | 8/1910 | Morgan | |
| 1,000,310 | A | 8/1911 | Ward | |
| 2,382,218 | A | 8/1945 | Fernstrum | 115/0.5 |
| 2,462,450 | A | 2/1949 | Wilson | 115/0.5 |
| 2,612,858 | A | 10/1952 | Mairs | 115/0.5 |
| 2,682,852 | A | 7/1954 | Ruffolo | 115/0.5 |
| 2,976,834 | A | 3/1961 | Waldron et al. | 115/0.5 |
| 3,177,936 | A | 4/1965 | Walter | 165/179 |
| 3,240,179 | A | 3/1966 | Van Ranst | 115/0.5 |
| 3,561,524 | A | 2/1971 | Satterthwaite et al. | 165/76 |
| 4,043,289 | A | 8/1977 | Walter | 115/75 |
| 4,215,744 | A | 8/1980 | Bowles | 165/158 |
| 4,338,993 | A | 7/1982 | Fernstrum | 165/44 |
| 4,557,319 | A | 12/1985 | Arnold | 165/44 |
| 5,355,947 | A * | 10/1994 | Rasso et al. | 165/176 |
| 5,931,217 | A | 8/1999 | Fernstrum | 165/44 |
| 6,099,373 | A | 8/2000 | Fernstrum | 440/88 |
| 6,575,227 | B1 * | 6/2003 | Leeson et al. | 165/44 |
| 6,581,679 | B1 * | 6/2003 | Fischer et al. | 165/174 |
| 2004/0079516 | A1 * | 4/2004 | Leeson et al. | 165/44 |

* cited by examiner

*Primary Examiner*—John K. Ford
(74) *Attorney, Agent, or Firm*—Dickinson Wright PLLC

(57) ABSTRACT

The invention relates to a method and apparatus for enhancing the heat transfer efficiency of a keel cooler by increasing the flow rate of coolant through the side tubes. Because the side tubes are exposed to a greater amount of fresh unhindered seawater, increasing the flow rate through the side tubes can have the effect of enhancing the overall heat transfer capability of the keel cooler. The invention relates to using apertures leading to the side tubes from the header and vice versa that are substantially arrow-shaped in design, wherein various benefits that lead to an increased flow rate are provided. The aperture is preferably symmetrically shaped so that a single die can be used to cut the aperture onto both side walls of the header.

19 Claims, 5 Drawing Sheets

Prior Art

METHOD AND APPARATUS FOR ENHANCING THE HEAT TRANSFER EFFICIENCY OF A KEEL COOLER

This application claims the benefit of Provisional Application No. 60/333,137, filed Nov. 27, 2001.

FIELD OF THE INVENTION

The present invention relates to the field of keel coolers, and in particular, to a method and apparatus for enchancing the heat transfer efficiency of a keel cooler by increasing the flow rate of coolant through the outer-most side tubes.

BACKGROUND OF THE INVENTION

Keel coolers are often used to cool mechanical equipment such as engines in a marine vessel. Keel coolers are typically located on the exterior of the marine vessel to enable cool seawater to directly pass over and contact the cooling tubes. The coolant is typically circulated through the cooling tubes and then passed through the engine which helps to cool the engine components, wherein the cycle is repeated, to enable heat to be transferred from the engine to the coolant, and in turn, to the cooling seawater.

In many keel coolers, two headers or manifolds (hereinafter "headers") are typically provided, with the cooling tubes connected to and extended between them. In such case, the coolant is allowed to pass from the engine into the first header, through the cooling tubes, and into the second header, before being circulated back to the engine. The first header acts as a transfer point for directing coolant from the engine into the tubes, and the second header acts as a transfer point for circulating coolant from the tubes back to the engine.

In such systems, the cooling tubes are often aligned, side-by-side, in a parallel manner with an outer-most tube on each side, and several intermediate tubes between them. For example, a keel cooler may have a total of eight cooling tubes, with six intermediate tubes, and two outer "side tubes," extending between the two headers. While the intermediate tubes are typically connected to an angled weir located on the header, the side tubes are typically located on and connected to the side walls of the header. In such case, apertures are provided (on the side walls) through which the coolant can pass directly from the header into the side tubes, and vice versa.

The flow rate of the coolant passing through the cooling tubes can have an effect on the efficiency of the keel cooler, i.e., heat transfer is velocity dependent. Accordingly, maximizing the flow rate of the coolant within the confines of the tube dimensions can increase the efficiency of the cooler. In this respect, in conventional keel coolers of this kind, the side tubes are typically exposed to a greater amount of unhindered fresh seawater, due to their location on the sides, than the intermediate tubes, although the intermediate cooling tubes generally tend to have higher overall flow rates than the side tubes. Accordingly, one way to increase the efficiency of keel coolers without changing the dimensions of the cooling tubes is to enhance the flow rate through the side tubes, i.e., bring them to a level closer to that of the intermediate tubes.

In the past, apertures have been provided on the side walls of headers to allow coolant to pass into and out of the side tubes, and these have been circular in shape. Such apertures, however, have not always achieved the desired flow rate levels for enhanced keel cooler efficiency. What is needed, therefore, is an improved aperture design that increases the flow rate through the side tubes, which can enhance the overall heat transfer efficiency and performance of the keel cooler, without having to change the overall construction and dimensions of the keel cooler.

SUMMARY OF THE INVENTION

The present invention relates to a method and apparatus for improving the flow rate of coolant through side tubes that extend along the sides of a keel cooler, wherein the apertures that extend between the header and side tubes are specifically shaped and adapted to improve the flow rate therethrough. While past apertures have been circular in shape, the present invention contemplates using shapes that are designed to help increase the flow rate through the side tubes, i.e., by virtue of their unique configuration and/or orientation, which in turn can enhance the heat transfer efficiency of the cooler.

In one aspect, the apertures of the present invention are adapted to encourage the flow rate through the center of the side tubes, without necessarily limiting or restricting the flow along the top and bottom. This can be accomplished, for example, by increasing the longitudinal dimensions along the top and bottom, wherein an increase in flow, as well as an even flow distribution across the entire cross-section of the tube, can be achieved.

In another aspect, the present invention contemplates reducing dead end pocket spaces that can otherwise be formed by circular apertures. Circular apertures tend to form corners on the ends of the side walls, which can create increased back pressure that can slow the flow of coolant. Avoiding corner spaces, and therefore, dead end pockets, can help reduce back pressure, which can lead to an increase in the flow rate through the side tubes.

In another aspect, the preferred shape comprises an enlarged center opening which enhances flow through the center. This can be accomplished, for example, by providing a funnel shaped aperture with a central point that increases the dimensions along the central flow zone, which can ease the transition of coolant from the header into the tubes, and vice versa.

In another aspect, the apertures are preferably cut from the side walls leaving a portion of the side walls intact, i.e., such as around the perimeter of the apertures. Leaving the side walls intact around the perimeter can help maintain the strength and structural stability of the side walls, which can enable the side tubes to be securely attached to the headers, such as by brazing and the like. Leaving a portion of the side walls intact around the perimeter, as opposed to cutting it all the way out, also has the effect of enhancing the flow rate, due to the reduction in the formation of low pressure areas along the side walls.

In another aspect, the edge of the aperture on the lower forward side is preferably made substantially parallel with the angled weir on the header. This design helps to remove or reduce blockage through the side tubes, thereby helping to increase the flow rate. On the other hand, the upper forward side of the aperture (opposite the parallel side) is preferably blocked to prevent the formation of a low pressure area, which can otherwise draw the coolant back out of the side tubes, at that location.

In another aspect, the aperture is preferably symmetrical about a horizontal axis, such that it can be stamped or cut using a symmetrical die, wherein the same die cutter can be used to form the apertures on either side wall of the header.

By making the die symmetrical, the same die can be used in either a reversed or up-side-down position.

The preferred embodiment of the present invention incorporates apertures having five sides or edges, with three edges forming three sides of a square or rectangle on one end, and two edges extending forward to form a symmetrcial point on another end, i.e., symmetrical about a horizontal center line. The angle of orientation of the lower forward edge is preferably formed by the angle of the weir on the header, wherein the lower edge preferably extends substantially parallel to the weir. The combination of the three edges forming three sides of a square or rectangle, and the two forward edges forming two sides of a triangle, preferably form a substantial arrow-shaped design. Tests show that this configuration increases the flow rate, as well as reduces the pressure drop across the entire cooler, which can further enhance the flow rate through the cooler. At least a portion of the side walls is preferably left intact around the perimeter of the aperture as discussed above.

Variations to the preferred shape are contemplated by the present invention. The shapes can be modified to provide similar enhancements. For example, the shape of the aperture can be more rounded, including the point and edges, which can also be slightly cut short or blunted without necessarily departing from the scope of the invention. Other shapes to accommodate different side wall and header configurations are also possible.

The present invention also contemplates that the above improvements can be provided in connection with various types of passages and openings, such as those used on conventional radiators and heat exchangers, i.e., used in automobiles, trucks, and other mechanical devices, wherein enhancements to the flow rate can be obtained thereby.

DETAILED DESCRIPTION OF THE INVENTION

Figure 1:
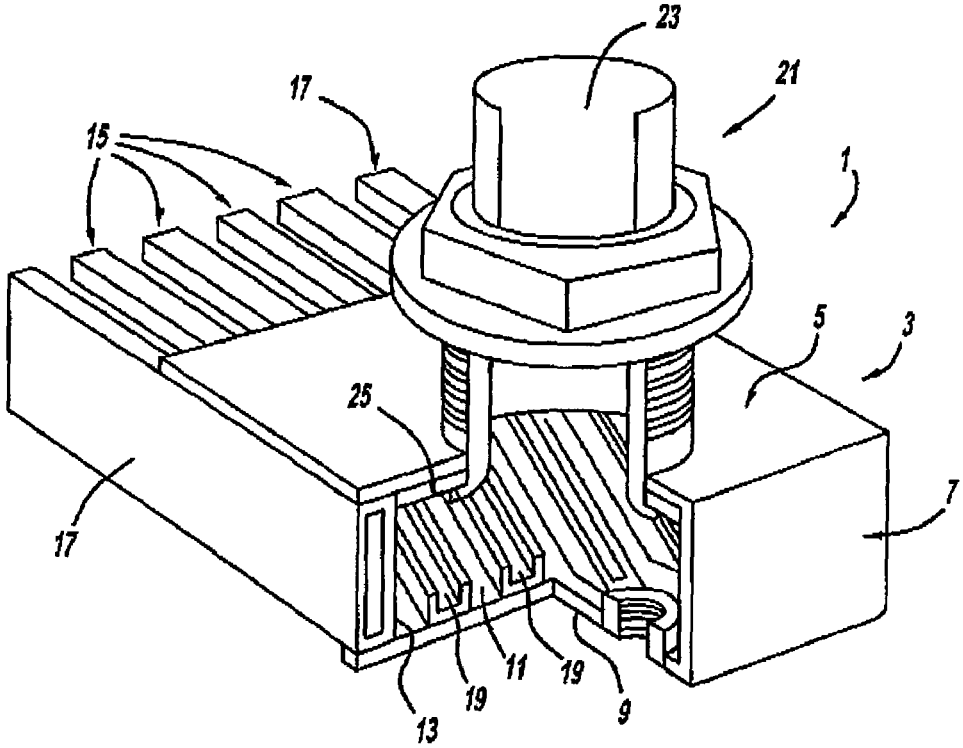
FIG. 1 is a perspective cut-away view of a keel cooler, showing the header and side tubes connected directly to the header.

FIG. 1 shows a cut-away portion of a keel cooler 1 having a header 3 on one end (the other end is not shown). The header 3 has a top wall 5, an end wall 7, a bottom wall 9, an angled weir 11, and two side walls 13 (only one is shown). The header 3 is connected to a plurality of cooling tubes, including intermediate tubes 15, and side tubes 17. The intermediate tubes 15 are preferably connected to the angled weir 11, as shown. Multiple openings 19 on the angled weir 11 communicate with intermediate tubes 15. The side tubes 17 are preferably connected along the sides of the header 3, wherein the interior walls of the side tubes can form the side walls 13. An aperture 20, such as those shown in FIGS. 2–7, is preferably provided on each side wall 13 to communicate with side tubes 17.

In one embodiment, a nozzle/nipple construction 21 preferably extends upward from top wall 5 of header 3, and is used to connect keel cooler 1 to the marine vessel, although other connecting means such as flanges are possible. A nipple plate 25 is preferably provided to strengthen the connection along the top wall 5. The nozzle/nipple construction 21 preferably has a bore 23 extending through it, through which the coolant can pass into header 3. The construction 21 is adapted to be connected to a conduit that leads to the engine.

With this structure, the coolant can enter one of the headers 3 from the engine through nozzle/nipple construction 21. The coolant can then pass from header 3 into intermediate tubes 15 through openings 19, and into side tubes 17 through apertures 20, as shown in FIGS. 2–7. On the opposite end of keel cooler 1, a similar header 3 is preferably provided, along with similar connections, wherein the coolant can pass from cooling tubes 15 and 17, through similar openings 19 and apertures 20, respectively, into the other header 3, and then back to the engine through a similar nozzle/nipple construction 21.

Figure 2:
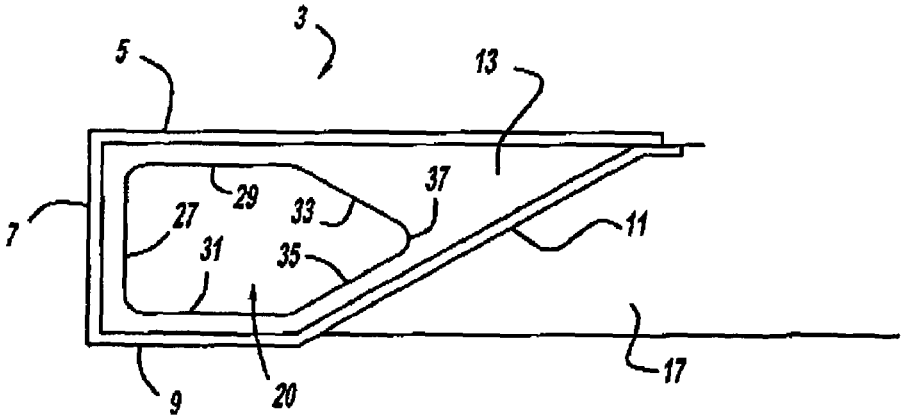
FIG. 2 is a side view of a side wall of the header of the present invention, taken from inside the header, showing the shape of the preferred aperture.

FIG. 2 shows a cut-away view of header 3, viewed from the inside of header 3 (the nipple plate 25 is not shown), with side wall 13, end wall 7, top wall 5, bottom wall 9, and angled weir 11. In this view, the inside of side tube 17 can be seen through aperture 20 located on side wall 13, i.e., the aperture 20 allows communication between header 3 and side tube 17.

The preferred shape of aperture 20 is shown in FIG. 2. This shape generally comprises five edges. Three of the edges 27, 29, 31 preferably form three sides of a substantial square or rectangle as shown. On the open end, there are preferably two additional edges 33, 35 that extend at an angle toward a point 37, forming a triangular arrow-shape design. The lower angled edge 35 is preferably cut at an angle that is substantially the same as the angle of weir 11, as shown, i.e., extending substantially parallel to angled weir 11, and the upper angled edge 33 preferably extends symmetrically (about a horizontal axis) on the upper half. The corners where the edges meet are preferably slightly rounded, although not necessarily so, for smooth flow transition. The entire shape is preferably symmetrical about a horizontal axis.

Figure 4:
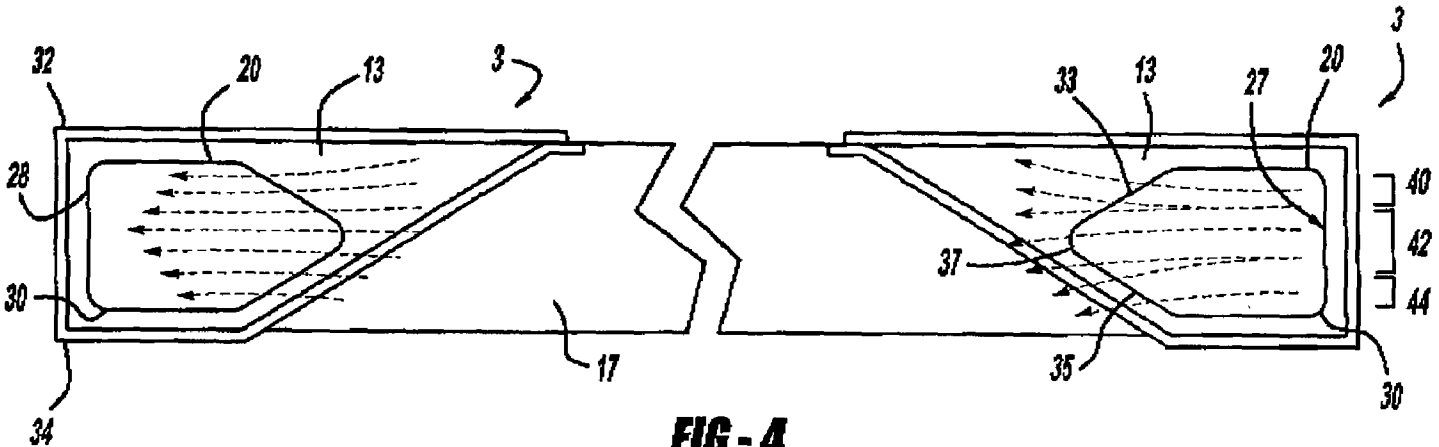
FIG. 4 is a cut-away side view of the present invention, showing the preferred arrow-shaped apertures on the side walls leading to the side tubes.

The preferred shape creates horizontal flow zones 40, 42 and 44, as shown in FIG. 4. The central flow zone 42 extends substantially through the center of side tube 17, and upper and lower flow zones 40, 44, respectively, extend above and below.

Figure 3:
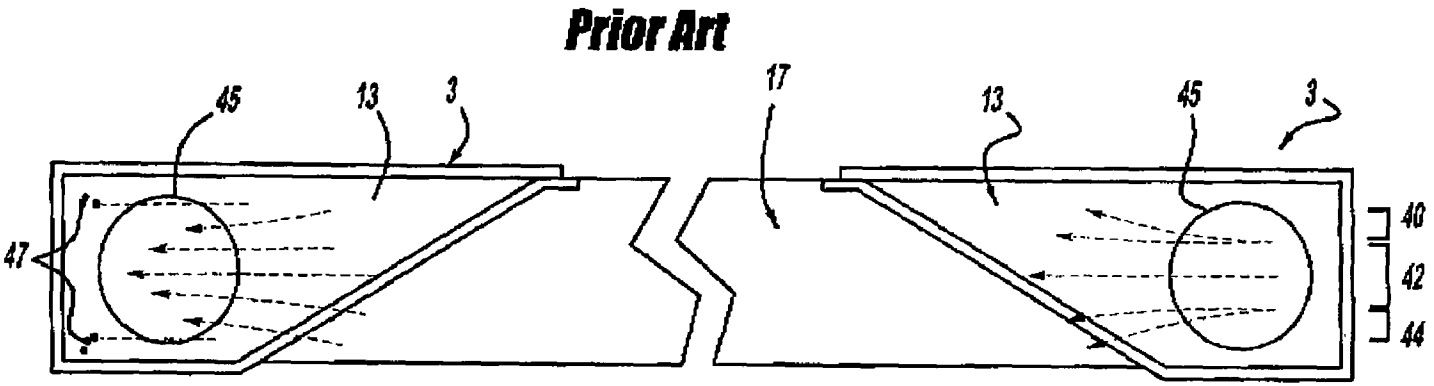
FIG. 3 shows a prior design with circular apertures.

In any given keel cooler 1, coolant enters side tube 17 through one aperture in one header 3, and exits through another aperture in the other header 3. In FIG. 3, a side tube 17 of a conventional keel cooler is shown with apertures 45 having a circular shape. In this depiction, coolant enters side tube 17 from the right end and exits through the left end, through apertures 45. The coolant travels through side tube 17, which is preferably rectangular in cross-section. Typically, apertures 45 have cross-sectional areas larger than side tubes 17, such that flow through the keel cooler is not substantially restricted thereby.

The shape of conventional aperture 45, however, has several deficiencies. For example, the shape encourages flow through the center of the side tubes, but restricts flow along the top and bottom. As can be seen, the circular shape provides a relatively large central flow zone 42, but provides very small upper and lower flow zones, 40, 44, which make it difficult to evenly distribute flow across the entire cross-section of side tube 17. The shape of aperture 45 also produces dead end pocket spaces 47, i.e., in the corners, that can create increased back pressure, which can lead to slower flow. Dead end pocket spaces 47 formed by the circular shape can trap coolant in the corners, thereby increasing back pressure, and slowing the flow through the side tubes 17.

In Applicant's invention, the preferred shape of aperture 20 has several advantages over conventional circular shaped apertures 45.

First, unlike circular shapes, the arrow-shape design of the present invention encourages the flow of coolant along the top and bottom. Forming larger longitudinal dimensions along the top and bottom leads to the formation of larger upper and lower flow zones 40, 44, wherein the flow of coolant can be distributed more evenly across the entire cross-section of side tubes 17.

Second, the longitudinal dimension along the central flow zone 42 is enlarged to enhance the flow of coolant through the center of the side tube 17. Forming a substantial arrow or funnel shape with the angled edges 33, 35 allows not only the upper and lower flow zones 40, 44 to be enlarged, but also the central flow zone 42 as well, i.e., by extending central point 37, as shown in FIG. 2, to a distance from edge 27 that is substantially greater than the longitudinal dimensions of edges 29 and 31. The funnel shape of aperture 20, pointing on the right end in the direction of flow, as shown in FIG. 4, helps to ease the transition of flow from header 3 into side tube 17. On the opposite end, the funnel shape of aperture 20 helps to ease the transition of flow from the side tube 17 into header 3.

Third, the shape of aperture 20 reduces dead end pocket spaces that can otherwise be formed by circular apertures 45. In Applicant's invention, by extending corners 28, 30 of aperture 20 further toward corners 32, 34 of header 3, dead end pockets spaces can be reduced, which in turn, can help reduce back pressure, and can lead to increased flow through side tubes 17.

Fourth, apertures 20 are preferably cut from side walls 13 leaving a portion of the side walls 13 intact, i.e., such as around the perimeter of apertures 20. Leaving side walls 13 intact around the perimeter helps maintain the strength and structural stability of side walls 13 and header 3, by allowing the side tubes 17 to be securely attached to headers 3, such as by brazing and the like. Leaving a portion of side walls 13 intact around the perimeter, as opposed to cutting it all the way out, also has the effect of enhancing the flow rate, which was an unexpected result. It would have been expected for the flow rate to be increased by making the aperture as large as possible, i.e., by cutting out the entire side wall 13, but tests have shown that the flow rate is actually increased by leaving the perimeter intact, presumably due to the reduction in the formation of low pressure areas along side walls 13.

Fifth, the lower angled edge 35 is preferably made substantially parallel with the angled weir 11 on the header 3. This helps to remove or reduce blockage through the side tubes 17, thereby helping to increase the flow rate. On the other hand, the upper angled edge 33 of aperture 20 is preferably blocked to prevent the formation of a low pressure area, which could otherwise draw the coolant back out from side tubes 17.

Sixth, aperture 20 is preferably symmetrical about a horizontal axis, such that it can be stamped or cut using a symmetrical die. The same die cutter can be used to form apertures 20 on either side wall 13 of header 3. Making the die symmetrical allows the same die to be used in either a reversed or up-side-down position.

Tests have been conducted on samples of keel coolers having eight tubes each. Sample One incorporates the arrow-shaped aperture design of the present invention. That sample has been compared to Sample Two, a similar eight tube keel cooler, but with conventional circular apertures. A Doppler flowmeter was used with a correction factor relating to the rectangular shape of side tubes 17, and a 60 degree angled weir 11. Flow readings were obtained for each cooling tube, including the intermediate tubes 15 and side tubes 17, of both Samples One and Two.

Figure 8:
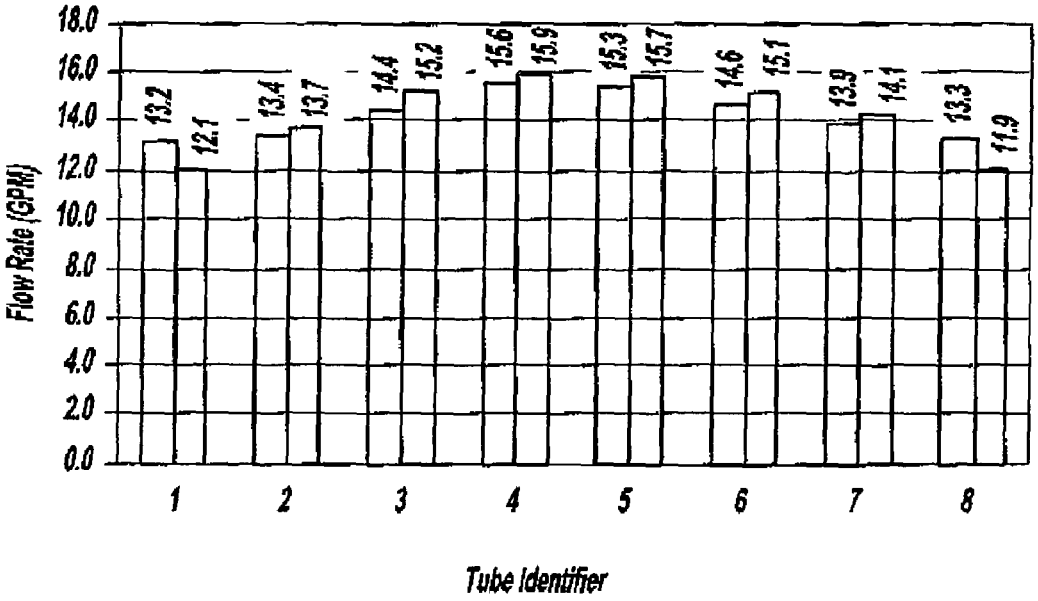
FIG. 8 is a chart showing test results of sample keel coolers.

FIG. 8 represents a chart showing the results. The tubes of each sample are numbered from one to eight along the bottom, with side tubes 17 being represented by identifiers one and eight, and the intermediate tubes 15 being represented in order by identifiers two through seven. A pair of bars is shown for each of the eight tubes, wherein the bars indicate the tested flow rates, numbered from 0.0 to 18.0 (in GPM's) along the left side of the chart. The first bar of each pair represents the flow rates (GPM) using Sample One (with the preferred aperture 20), and the second bar of each pair represents the flow rates (GPM) using Sample Two (with conventional circular aperture 45).

The tests show that with respect to tubes one and eight, which represent the two side tubes, the flow rate was increased by about 10%, namely, from 12.1 GPM to 13.2 GPM for tube one, and from 11.9 GPM to 13.3 GPM for tube eight, using Sample One (with the preferred aperture 20). That is, the first bar of each pair, which represents Sample One using the preferred aperture 20, shows that the flow rate increased by about 10% over that obtained by using the circular aperture 45 of Sample Two. Tests of the other six intermediate tubes, however, indicate that the flow rates through the intermediate tubes were slightly decreased by using the preferred aperture 20 in Sample One. That is, the first bar of each pair, which represents the preferred aperture 20 configuration, shows that the flow rate using Sample One decreased slightly over that obtained by using Sample Two, although to a much lesser degree.

It can be seen that the overall flow rate through all eight tubes has been kept substantially constant, but the distribution of flow through the various individual tubes has been altered to reflect higher flow rates through the side tubes and slightly slower flow rates through the intermediate tubes. That is, the overall flow rate through the keel cooler remains the same, but the increase in the flow rate through the side tubes would necessarily have the reciprocal effect of decreasing the flow rate through the intermediate tubes, although to a lesser degree (since there are six intermediate tubes and only two side tubes).

Although the overall flow rate through the keel cooler has not changed, the heat transfer efficiency of the cooler has been enhanced because the side tubes are exposed to a greater amount of unhindered fresh seawater, as discussed above, than the intermediate tubes. That is, the effect of increasing the flow rate through the two side tubes, and reciprocally reducing the flow rate through the six intermediate tubes (although to a lesser degree each), is to cause the keel cooler to operate more efficiently, i.e., to provide greater heat transfer, using the same cooling tubes. Since greater exposure to seawater is encountered by the side tubes than the intermediate tubes, and the flow rate of coolant through the side tubes has been increased, the overall heat transfer efficiency of the keel cooler is enhanced using the arrow-shaped aperture 20 of the present invention. In this respect, it has also been found that by reducing obstructions to the flow rate, a lower overall pressure drop across the entire keel cooler of Sample One was experienced over that of Sample Two.

Although additional tests were conducted of various shaped apertures, and it was found that the preferred shape performed most efficiently, the present invention contemplates that slightly different shapes are possible. Although the preferred design incorporates all of the aspects of the invention discussed above, the present invention contemplates that the aperture can be provided with fewer than all of the features, wherein the design could still provide some of the same benefits, without departing from the scope of the invention.

Figure 5:
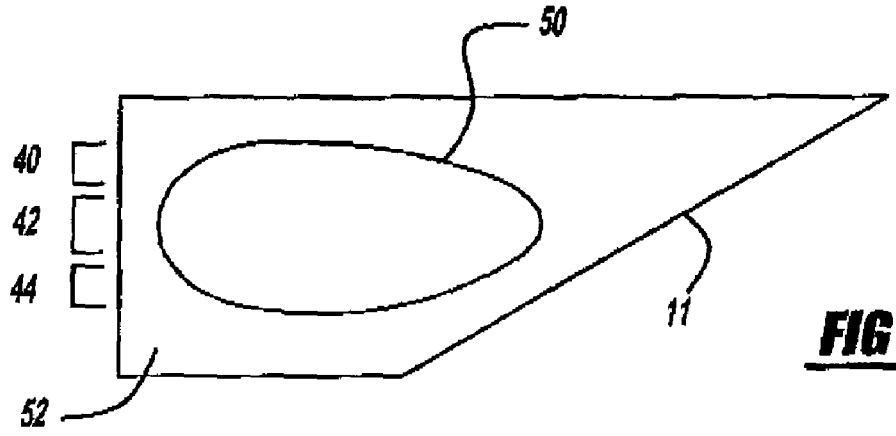
FIGS. 5–7 show alternate aperture shapes of the present invention.

For example, the arrow-shaped design can be modified with rounded corners and edges 50, as substantially shown in FIG. 5, wherein the central flow zone 42, as well as the upper and lower flow zones 40, 44, are enlarged. Although the angles of the forward sides are not consistent with the angle of weir 11, and dead end pocket spaces 52 are not significantly reduced, this shape can provide some of the same benefits discussed above, although not to the same degree.

Figure 6:
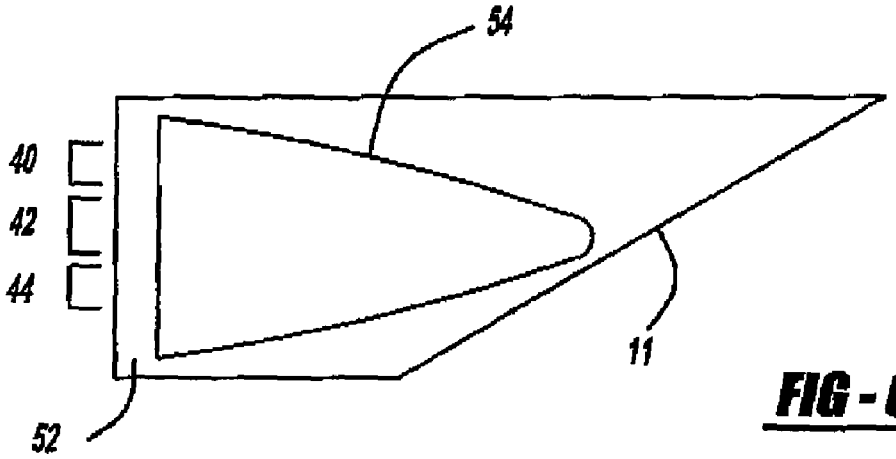

FIG. 6 shows an additional shape where the central flow zone 42 is increased, but the upper and lower flow zones 40, 44 are not enlarged. The angles of the forward sides 54 also do not match the angle of the weir 11, but the dead end pocket spaces 52 are reduced. While this design provides some marginal benefits on account of the funnel shape design, i.e., being able to provide better transition from the header to the side tubes, and vice versa, the benefits are not provided to the same degree as in the preferred embodiment.

Figure 7:
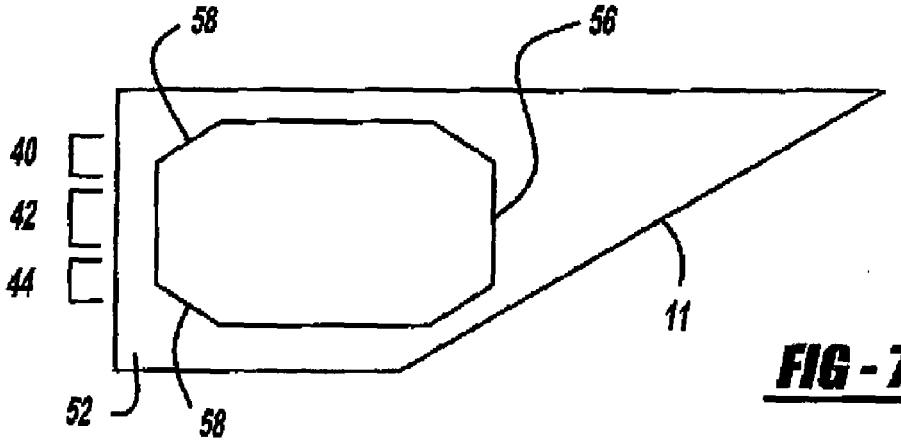

FIG. 7 shows another shape where the point 56 is blunted, and the corners 58 are cut off. Although this design provides an increase in the central, upper and lower flow zones 42, 40, 44, the dead end pocket spaces 52 are not significantly reduced, and therefore, this shape provides only some of the benefits discussed above.

Figure 9:
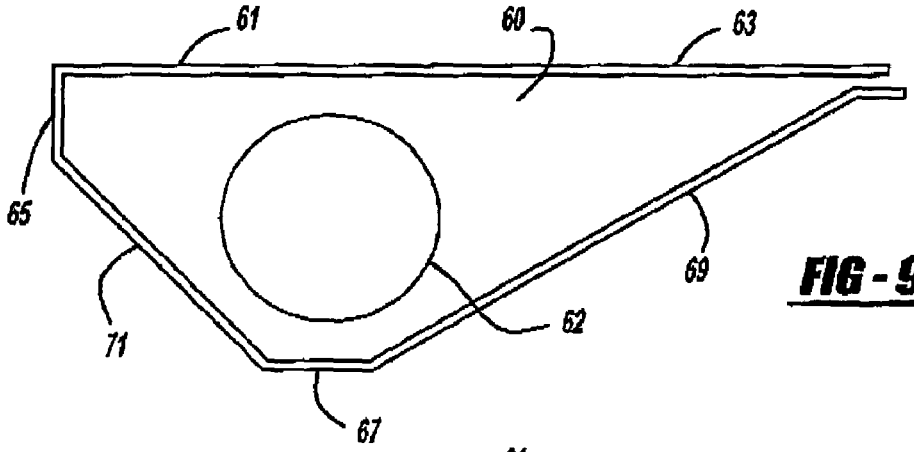
FIG. 9 shows a prior side wall design with a circular aperture for a header having a different configuration.

FIG. 9 shows the shape of another prior art header 61 having a different configuration, with side wall 60 having a circular aperture 62. This header 61 has a top wall 63, an end wall 65, a bottom wall 67, an angled wier 69, and an extra face 71 on a rearward end. This side wall 60, like the one shown in FIG. 3, has a circular aperture 62, and therefore, has many of the same disadvantages as aperture 45.

Figure 10:
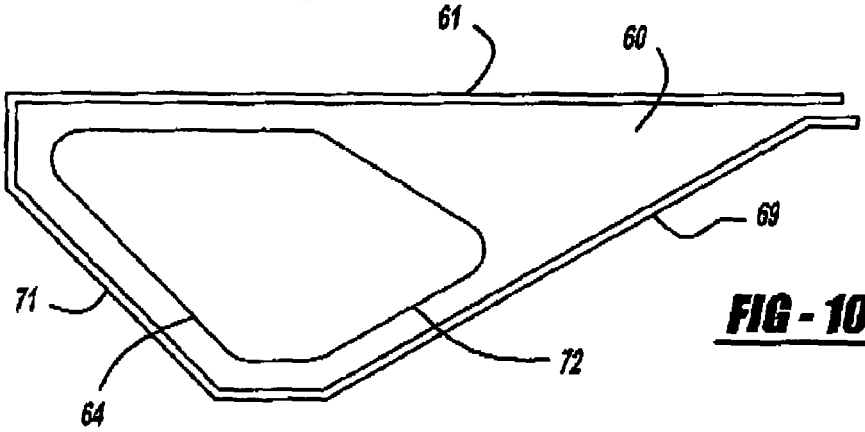
FIGS. 10–11 show alternate embodiments of the present invention with alternate aperture shapes for a header having a different configuration.

FIG. 10 shows the header 61 having a side wall 60 with an assymmetrical aperture 72 having most of the same characteristics of aperture 20 shown in FIG. 2. For example, it can be seen that aperture 72 is substantially similar in shape to aperture 20 in all respects, except that the lower rear edge 64 has been cut away to accommodate and be parallel to extra face 71.

Figure 11:
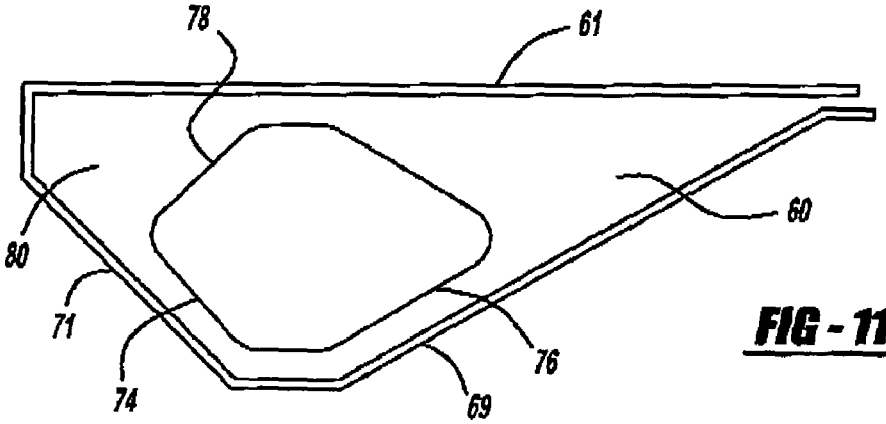

FIG. 11 shows the header 61 having a side wall 60 with a symmetrical aperture 76 that has most but not all of the same characteristics of aperture 20. Aperture 76 is similar to aperture 72, except that the upper rear edge 78 has been cut to be symmetrical about a horizontal axis to lower rear edge 74. This design has many of the same characteristics as aperture 72, but does not reduce dead end pocket space 80.

The invention has been described in terms of the preferred embodiments. However, the present invention is not intended to be limited to only those embodiments that are disclosed herein. The present invention is intended to comprise other embodiments that provide substantially the same benefits described herein, which are encompassed by the following claims.

What is claimed is:

1. A heat exchange assembly comprising:

a header having top, end, side and bottom walls, and an angled wall connected to said top, side and bottom walls extending along a predetermined plane, a cooling side tube extending from said header, and at least one wall separating said header and said cooling side tube, wherein an aperture is provided on said at least one wall, said aperture being formed by edges comprising:

an upper section and a lower section extending substantially parallel to each other, a first end section extending between said upper and lower sections on a first end, and a second end section extending between said upper and lower sections, and extending in a direction toward a second end that is opposite said first end, wherein said second end section comprises angled and/or curved upper and lower edge sections that meet to form said second end section, wherein said upper and lower sections are substantially parallel to said top and bottom walls, respectively, and said first end section is substantially normal to said upper and lower sections, and said upper and lower edge sections form a point or substantially blunted or rounded point extending in said direction, wherein said lower edge section extends substantially parallel to said predetermined plane.

2. The heat exchange assembly of claim 1, wherein said aperture is substantially symmetrical in relation to a horizontal center.

3. The heat exchange assembly of claim 1, wherein a portion of said at least one wall is left intact around a perimeter of said aperture.

4. A heat exchange assembly comprising:

a header having top, end, side and bottom walls, and an angled wall connected to said top, side and bottom walls extending along a predetermined plane, a cooling side tube extending from said header, and at least one wall separating said header and said cooling side tube, wherein an aperture is provided on said at least one wall, said aperture being formed by edges comprising:

an upper section and a lower section extending substantially parallel to each other, a first end section extending between said upper and lower sections on a first end, and a second end section extending between said upper and lower sections, and extending in a direction toward a second end that is opposite said first end, wherein said second end section comprises angled and/or curved upper and lower edge sections that meet to form said second end section, wherein said header has a second angled wall connected to said end, side and bottom walls extending along a second predetermined plane on a rearward portion of said header, wherein said upper and lower sections are substantially parallel to said top and bottom walls, respectively, and said upper and lower edge sections form a point or substantially blunted or rounded point extending in said direction, and wherein said lower edge section extends substantially parallel to said predetermined plane, and at least a portion of said first end section extends substantially parallel to said second predetermined plane.

5. The heat exchange assembly of claim 4, wherein said aperture is substantially symmetrical in relation to a horizontal center.

6. The heat exchange assembly of claim 4, wherein a portion of said at least one wall is left intact around a perimeter of said aperture.

7. An assembly having a header communicating with at least one passageway, said header having at least one wall separating said header and said at least one passageway, wherein an aperture is provided on said at least one wall, said aperture comprising:

an upper section having a first dimension and a lower section having a second dimension;

a first end section extending between said upper and lower sections at a first end;

a second end section extending between said upper and lower sections at a second end; and wherein said second end section has upper and lower angled and/or curved edges that substantially come together at a predetermined location opposite said first end section, wherein said second end section extends relative to said first end section a distance greater than said first and second dimensions of said upper and lower sections, wherein said upper and lower sections are substantially parallel to each other, and said first and second dimensions are substantially equal, and wherein said first end section is substantially normal to said upper and lower sections.

8. The assembly of claim 7, wherein said upper and lower angled and/or curved edges form a point or substantially blunted or rounded point extending in a direction opposite said first end section.

9. The assembly of claim 7, wherein a portion of said at least one wall is left intact around a perimeter of said aperture.

10. The assembly of claim 7, wherein said lower angled and/or curved edge extends substantially parallel to an angled wall of said header.

11. The assembly of claim 7, wherein said aperture is substantially symmetrical in relation to a horizontal center.

12. The assembly of claim 7, wherein said second end section extends relative to said first end section a distance greater than a distance between said upper and lower sections.

13. A header for use in a keel cooler system, the header comprising:

a top wall;

a bottom wall;

an end wall;

an angled weir disposed generally opposite said end wall;

a pair of opposed side walls; and a liquid-passing aperture defined in at least one of said pair of opposed side walls, said liquid-passing aperture comprising:

an upper edge, said upper edge being substantially parallel to said top wall, a lower edge, said lower edge being substantially parallel to said bottom wall, a first end edge extending between said upper and lower edges at a first end, said first end edge being substantially normal to said upper and lower edges, and a second end edge extending between said upper and lower edges at a second end, said second end edge comprising an upper portion and a lower portion, wherein said upper and lower portions meet at a point or substantially blunted or rounded point.

14. The header of claim 13, wherein said lower portion of said second end edge is substantially parallel to said angled weir.

15. The header of claim 13, wherein said second end edge further comprises a middle portion arranged between said upper and lower portions.

16. The header of claim 13, wherein said upper edge and said upper portion of said second end edge together comprise a unitary arc.

17. The header of claim 13, wherein said lower edge and said lower portion of said second end edge together comprise a unitary arc.

18. The header of claim 17, wherein a portion of said unitary arc is substantially parallel to said angled weir.

19. The header of claim 13, wherein said liquid-passing aperture is substantially symmetrical in relation to a horizontal center.

* * * * *